US006191672B1

(12) United States Patent
Lages et al.

(10) Patent No.: US 6,191,672 B1
(45) Date of Patent: Feb. 20, 2001

(54) RELAY SOCKET

(75) Inventors: Klaus Lages, Suthfeld; Hans-Joachim Koslowski, Gifhorn, both of (DE); Joris Dobbelaere, Beernem (BE)

(73) Assignee: Siemens Aktiengesellschaft, Munich (DE)

( * ) Notice: Under 35 U.S.C. 154(b), the term of this patent shall be extended for 0 days.

(21) Appl. No.: 09/230,329

(22) PCT Filed: Jan. 28, 1998

(86) PCT No.: PCT/DE98/00249

§ 371 Date: Jan. 22, 1999

§ 102(e) Date: Jan. 22, 1999

(87) PCT Pub. No.: WO98/33240

PCT Pub. Date: Jul. 30, 1998

(30) Foreign Application Priority Data

Jan. 28, 1997 (DE) ..... 197 03 006

(51) Int. Cl.[7] ..... H01H 9/02
(52) U.S. Cl. ..... 335/202; 335/78; 439/810
(58) Field of Search ..... 335/78–86, 128, 335/132, 202; 439/638–9, 720–725, 810–814

(56) References Cited

U.S. PATENT DOCUMENTS 5,295,870 * 3/1994 Rei et al. ..... 439/717
5,454,733 * 10/1995 Watanabe et al. ..... 439/540.1
5,749,739 * 5/1998 Saka et al. ..... 439/76.2
5,873,753 * 2/1999 Norris, Jr. et al. ..... 439/572

FOREIGN PATENT DOCUMENTS 387 121 4/1965 (CH) .
25 55 138 6/1977 (DE) .
28 43 095 4/1979 (DE) .
88 11 020 12/1988 (DE) .
42 07 091 6/1993 (DE) .
42 27 182 12/1993 (DE) .
0 007 709 9/1981 (EP) .
2 218 272 11/1989 (GB) .

* cited by examiner

*Primary Examiner*—Lincoln Donovan
(74) *Attorney, Agent, or Firm*—Schiff Hardin & Waite

(57) ABSTRACT

A plug socket for relays has contact chambers that comprise plug slots open toward an upper base member side for the acceptance of flat plugs and into which plug jacks are inserted proceeding from the underside. These plug jacks have catch tongues branched off at both sides for latching in catch channels of the contact chambers. The contact chambers with the inserted plug jacks are narrower than the plug slots and are offset in alternation toward the ends of the plug slots. The oppositely applied catch channels are thus offset relative to one another in the partitions. In this way, more standard contact jacks can be accommodated in standardized contact chambers in the same space than present aligning arrangement of the contact chambers.

7 Claims, 3 Drawing Sheets

RELAY SOCKET

BACKGROUND OF THE INVENTION

1. Field of the Invention

The present invention is directed to a plug socket for relays and more particularly to a plug socket for relays having flat plugs.

2. Description of the Prior Art

Plug sockets which receive at least one relay having flat plugs are known in the art. A typical plug socket comprises a base member of plastic in which contact chambers proceeding in the plug-in direction are formed. Plug in slots open toward the upper side of the base member proceeding therefrom for the acceptance of the flat plugs, and the contact chambers open toward the underside of the base member for receiving spring tongue pairs projecting fork-shaped upwardly into the region of the plug-in slots for the insertion of contact jacks, whereby the contact chambers respectively comprise retro-salient patch channels for the acceptance and locking of catch tongues at opposite side regions, said catch tongues being branched off from the correspondingly opposite outsides of the contact jacks.

Plug sockets are employed, for example, in automotive electronics. Standard dimensions have developed out particularly for use in automotive electronics. For example, flat plugs have standard widths of 6.3 mm, 4.8 mm and 2.8 mm. Corresponding to the standard plug dimensions, standard dimensions have also developed for the contact chambers in the plug sockets and for the contact jacks within the contact chambers. Contact jacks of a type standard are in plug-type connectors usually employed.

A contact jack employing two-sided latching via catch tongues is shown, in general terms in DE 88 11 020 U1. Due to the two-sided latching of the contact jack, the contact chambers including the catch channels require substantially more space in the transverse direction relative to the plug plane than would be required by the plug thickness and the spring tongues. This has an effect on the spacing of neighboring plug slots.

Standard dimensions have likewise developed for the outside contours and for the terminal configuration of relays in automobiles. Automobile relays normally have four or five connection plugs, namely two terminals for the coil and two terminals for a make contact or break contact or, three terminals for the change-over contact. In standard relays, there is adequate space for five standard terminals in the corresponding plug sockets, whereby standard dimensions have also developed for the contact chambers. However, more and more space problems arise for installation given the constantly increasing number of relays that are utilized in automobiles. Since, the high break capacities that a standard relay handles are not required for many applications, miniaturized relay types have been developed that cover approximately half the area of a standard relay, so that installation space is saved by employing them. This, however, should occur such that the two miniature relays can be accommodated on the space of a standard relay, so that the overall grid of the relay terminal units can be retained. For two relays having only one make contact or break contact, the corresponding contact chambers can be accommodated without further ado in a plug socket having standard dimensions. For relays with change-over contact, by contrast, difficulties arise in accommodating three contact chambers having standard dimensions with corresponding standard plug jacks on the available space, since these plug jacks latched at both sides require a relatively greater width, as mentioned above.

It has in fact already been disclosed thereto to employ plug jacks having only single-sided latching, as shown, for example, in said EP 0 007 709 B1. Such an embodiment would manage with less the width of the contact chambers but does not offer the desired security of a two-sided latching. An additional, secondary securing in a plug connector housing is also shown in this document.

SUMMARY OF THE INVENTION

An object of the present invention is to provide a plug socket of the species initially cited for the acceptance of at least one relay, but preferably two or more relays, whereby standard plug jacks with two-sided latching can be arranged in space-saving fashion next to one another in standard contact chambers.

This goal is inventively achieved in that the plug slots for two or more flat plugs arranged next to one another with their principle planes parallel are arranged with the same width corresponding to the plug width and aligned with one another; wherein the contact chambers for the acceptance of contact jacks are fashioned with less of a width than that of the plug slots and are displaced in alternation toward opposite ends of the slot width and wherein the catch shells respectively engaging oppositely into a common partition from neighboring contact chambers are displaced in the direction of the slot width relative to one another without overlap.

In the invention, the catch channels of the contact chambers lying next to one another are arranged offset relative to one another or nested, so that the partition need not comprise twice the depth of a catch channel and, additionally, the required insulation thickness. Pather, these catch channels engage into the partition passed one another at different location. The partition between two respective contact chambers can thus assure the required insulation and mechanical strength even with less thickness. This is enabled by the employment of narrower contact jacks in comparison to the broader flat plugs of the relay, as a result whereof the plug jacks can themselves be arranged respectively offset compared to the flat plugs.

The standardized plug cross-sections with the corresponding width is [sic] not required for many uses having a lower switched current. The narrower plug jacks in the base suffice for these uses. The broader flat plugs are thus inserted into narrower sockets that, however, do not lie centrally relative to them but offset in alternation toward the lateral edges.

In order to achieve a secondary locking of the plug jacks, which is required in many plug sockets for automobile relays, it is provided in a known way in a preferred embodiment that a secondary latching slide is arranged in the housing respectively under the contact chamber arrangement for a relay, said secondary latching slide comprising a continuous plug-in shaft under each and every contact chamber and being displaceable perpendicular to the plug-in axis between a mounting position and a final position such that each plug-in shaft aligns with the pertaining contact chamber in the mounting position in order to enable insertion of a contact jack, and in that a locking edge of the slide covers its part of the contact chamber cross-section in the final position in order to lock an inserted contact jack.

The base member for every locking slide preferably forms a locking chamber, whereby those sidewalls of the base member lying opposite one another, on the one hand, and opposite the slide on the other hand comprise inter-engaging catch elements for pre-latching the slide in the mounting position and for locking in the final position.

DESCRIPTION OF THE PREFERRED EMBODIMENT

Figure 1:
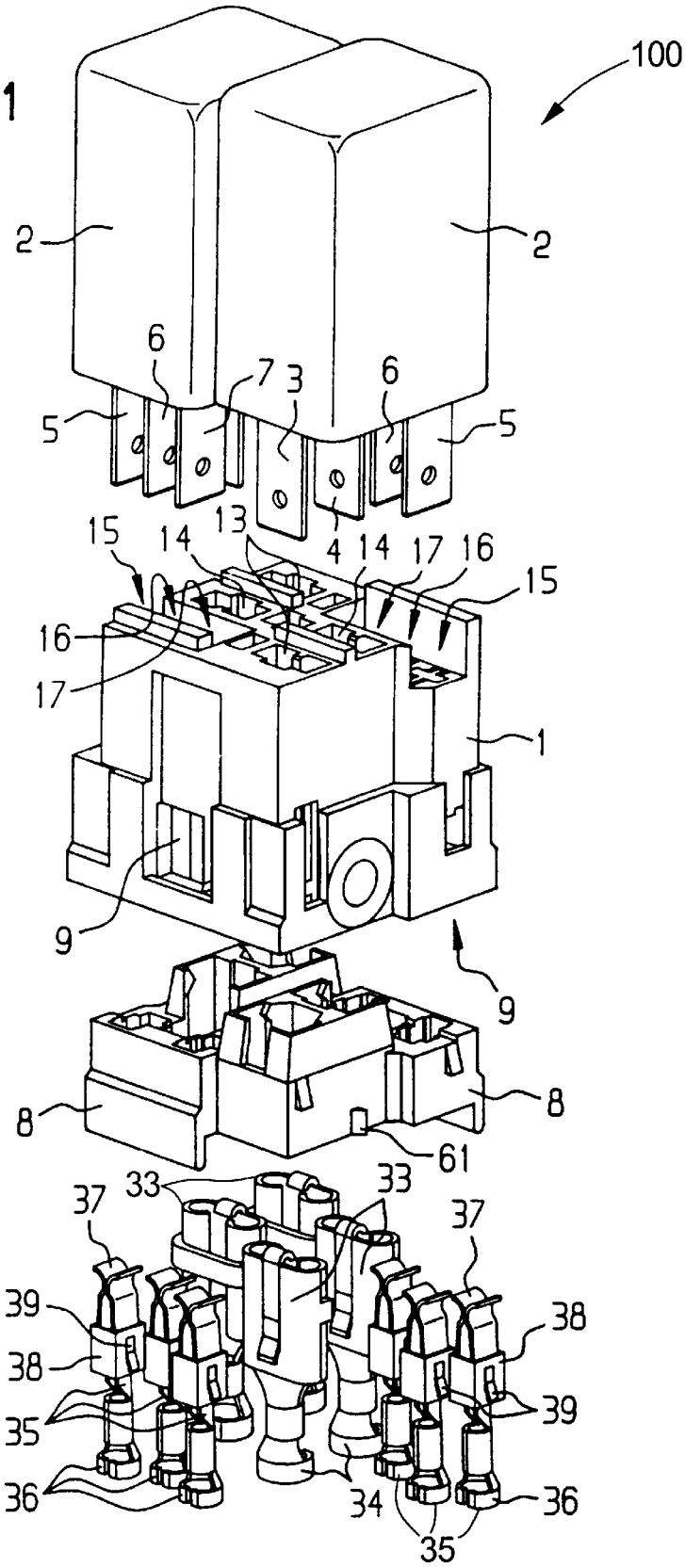
FIG. 1 is an exploded, perspective view of a plug socket having two relays to be plugged in, the secondary locking slides provided for mounting, and the plug jacks.

FIG. 1 shows the assembly sequence of an inventively fashioned plug socket 100. At its upper side, a base member 1 comprises plug slots 13 through 17 for the acceptance of two relays 2 that are identically constructed but are arranged side-by-side turned 180° relative to one another. Each of these relays has two broad flat plugs 3 and 4 and three contact terminals in the form of flat plugs 5, 6 and 7 arranged transversely thereto with their principal planes parallel in alignment with one another in a row. For the acceptance of these flat plugs, the base member 1 comprises plug slots 13, 14 proceeding inward from its upper side and also comprises the plug slots 15,16 and 17 lying parallel in a row for each relay. These plug slots 13 through 17 can be seen in greater detail in FIG. 2.

Figure 2:
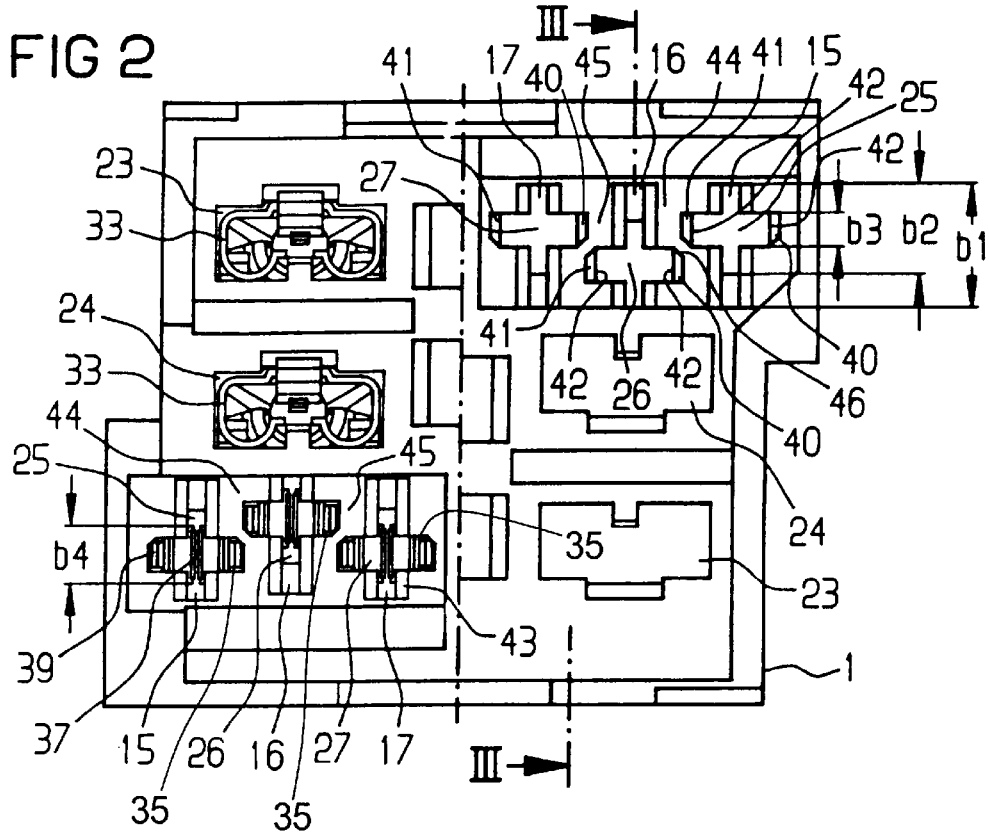
FIG. 2 is a plan view of the base member of the plug socket shown in FIG. 1.
Figure 4:
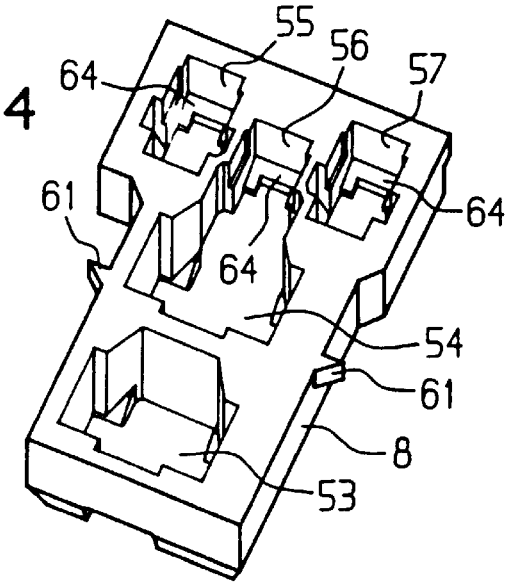
FIG. 4 is a perspective view from below of a secondary locking slide.
Figure 5:
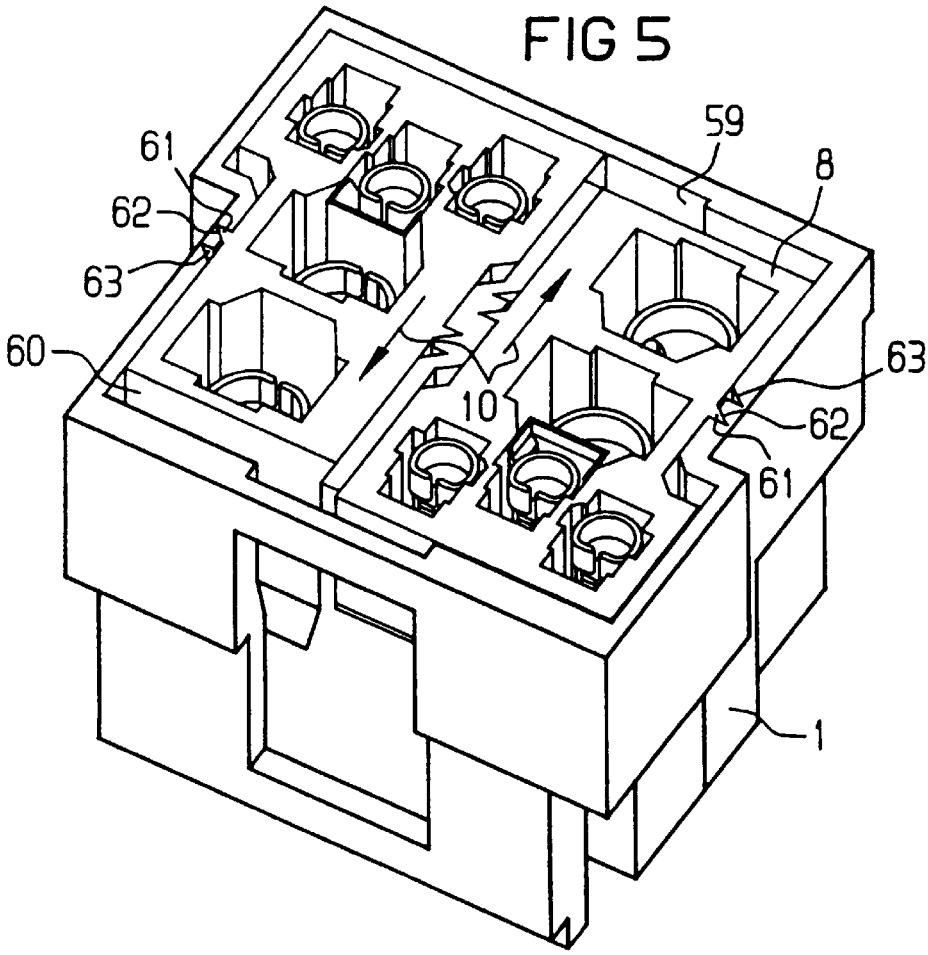
FIG. 5 is a perspective view from below of the plug socket of FIG. 1 with mounted plug jacks and two secondary locking slides in their final position.

Two secondary locking slides 8 are inserted into the underside of the base member 1 into corresponding locking chambers 9, as shall be explained later with reference to FIGS. 4 and 5. Plug jacks 33 and 35 allocated to the flat plugs 13 through 17 are then inserted into corresponding contact chambers 23 through 27 through the secondary locking slides 8. Corresponding to the flat plugs 3 and 4, two identical plug jacks 33, which are adapted in a known way to the width of the flat plugs 3 and 4, are inserted into contact chambers 23 and 24 (FIG. 2). At their lower ends, they comprise respective crimp or clamp sleeves 34 with which terminals wires can be contacted in a known way.

Three identical plug jacks 35 are inserted into corresponding contact chambers 25, 26 and 27 (FIG. 2) under the plug slots 15, 16 and 17. These plug jacks 35 are likewise constructed in a known way with a crimp or clamp sleeve 36 at the underside for contacting a terminal wire and with four-shaped spring tongues 37 at their upper side that are bent apart dovetail-like at their ends for introduction of the flat plugs 5, 6 and 7. A box-shaped super-spring 38 serves the purpose of generating the contact pressure onto the spring tongue 37. Moreover, catch tongues 39 are bent downwardly outward at the super-spring 38 toward both sides, these catch tongues 39 spread outwardly into the respective contact chamber 25, 26 and 27 after the insertion of the plug jack 35 and thus effecting a both-sided locking in the catch channels 40 and 41 (FIG. 2) which are yet to be described.

Figure 3:
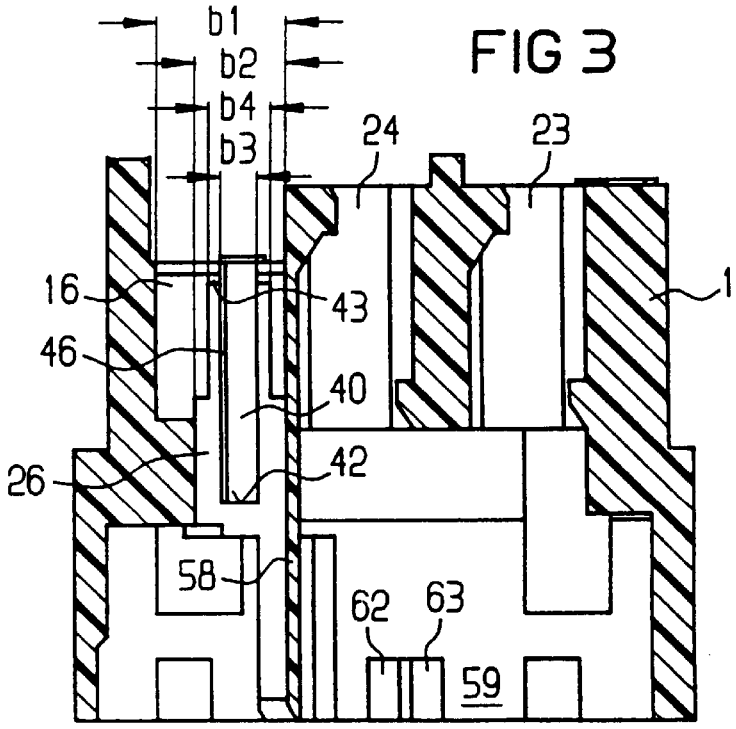
FIG. 3 is a sectional view taken along the line III—III of FIG. 2.

As particularly derived from FIGS. 2 and 3, the plug slots 15, 16 and 17 are arranged next to one another aligned in a row, i.e. have their principal planes parallel, whereby their width b1 corresponds to the width of the flat plugs 5, 6 and 7 (FIG. 1). The contact chambers 25, 26 and 27, however, have less of a width b2, just like the plug jack 35 secured in them, whereby these contact chambers 25, 26 and 27 are arranged oppositely displaced in alternation toward the ends of the plug slots 15, 16 and 17. The catch tongues 39 of the plug jacks 35 lock in catch channels 40 and 41 at both sides of each and every contact chamber 25, 26 and 27, namely above a respective catch edge 42. The width of the catch tongues 39 is adapted to the width b3 of the catch channels 40 and 41. The spring tongues 37 of the contact jacks 35 have a width b4; their side regions are covered by cover webs 43 of the plug slots 15, 16 and 17. The right half of FIG. 2 shows the base member in a plan view without equipping with plug jacks 33 and 35, whereas the left part of this Figure shows a plan view of the plug jacks 33 and 35 inserted from below.

Due to the offset arrangement of the contact chambers 25, 26 and 27, the pertaining catch channels 40 and 41 are also offset in width direction of the plug slots 15, 16 and 17 in alternation. As a result thereof, the partitions 44 and 45 between two respective contact chambers 25, 26 and 27 or, plug slots 15, 16 and 17 need not accept the full depth of two catch channels 40 and 41. For example, catch channel 41 of the contact chamber 25 thus extends without overlap next to the catch channel 40 of the contact chamber 26. The corners of the two catch channels 40 and 41 facing toward one another are beveled 46 in the illustrated example in order to also obtain an adequately thick insulating wall between the two channels 40 and 41 in this region. Since the catch tongues 39 are already somewhat narrower than the width b3 of the catch channel 40 and 41, the beveling 46 does not negatively effect the function of the inserted plug jacks 35.

What derives due to the offset of the plug jacks 35 in the pertaining contact chambers 25, 26 and 27 is that the spring tongues 37 do not contact the pertaining flat plugs 5, 6 and 7 (FIG. 1) over their entire width and also not centrally but only over approximately two-thirds of their width, namely proceeding in alternation from the one side on the one hand and from the other side on the other hand. Since, however, the flat plugs 5, 6 and 7 (FIG. 1) are already designed wider for reasons of standardization than necessary for the normal case, this contacting suffices for most instances.

In a known way, the plug jacks 33 and 35 (FIG. 2) are lent an additional secondary locking with the secondary locking slides 8 (FIG. 1) as mentioned above. Let this locking be described briefly with reference to FIGS. 4 and 5. In the region under each and every contact chamber 23 through 27 (FIG. 2), each secondary locking slide 8 comprises a through plug shaft, i.e. two plug shafts 53 and 54 below the contact chambers 23 and 24 (FIG. 2) as well as plug shafts 55, 56 and 57 below the contact chambers 25, 26 and 27 (FIG. 2). The plug shafts 54 and 56 merge into one another. In the present exemplary embodiment, the plug shafts 54 and 56 are only insulated by a partition 58 (FIG. 3) applied to the base member 1 after being plugged together. Each of the two slides 8 is inserted from below into a pertaining locking chamber 59 or, 60 of the base member 1, namely before the mounting of the plug jacks 33 and 55 (FIG. 2). They are thereby in a pre-locking position, whereby locking noses 61 applied to the sides of the slides 8 engage into a pre-locking notch 62 of the base member 1. In this mounting position shown in FIG. 5, the plug shafts 53 through 57 align with the contact chambers 23 through 27 (FIG. 2) lying thereabove. In this position, thus, the plug jacks 33 and 35 (FIG. 2) equipped with their pertaining terminal wires are plugged through the plug shafts 53 and 57 into the contact chambers 23 through 27 (FIG. 2) lying thereabove. Subsequently, the two slides 8 are displaced transverse to the plug-in direction in the direction of the arrows 10 in FIG. 5, whereby locking noses 61 proceed into the lock notches 63 and lock a final position of the slides 8 thereat. During this displacement, locking ledges 64 (FIG. 4) provided in the individual plug shafts 53 and 57 proceed under the box-shaped super-springs 38 and thus additionally secure the plug jacks 33 and 35 (FIG. 2) in their respective contact chamber 23 through 27 (FIG. 2).

The invention was described by way of example for two relays with a respective change-over contact; however, this principle of nesting of the contact chambers can also be fundamentally applied to other embodiments, for example two relays having four or more contact terminals such as, for example, for two make contacts. Of course, more than two relays can also be accommodated next to one another in a socket in the same way.

Although modifications and changes may be suggested by those of ordinary skill in the art, it is the intention of the inventors to embody within the patent warranted hereon all changes and modifications as reasonably and properly come within the scope of their contribution to the art.

What is claimed is:

1. A plug socket for at least one relay having flat plugs, said plug socket comprising a plastic base member having an upper side and a lower side, said base member including plug slots open toward said upper side of the base member for receiving an insertion of said flat plugs along a plug-in axis, each plug slot having a width corresponding to a width of the flat plug and a principle plane extending parallel and aligned with the principle planes of adjacent plug slots, said base member having contact chambers with each plug slot being in communication with a separate chamber and each chamber having a width less than the width of the plug slot, said contact chambers being displaced in alternation toward opposite ends of the width of the plug slots, each contact chamber having an opening extending toward the bottom side of the base member for receiving a plug jack, each plug jack having a pair of spring tongues projecting fork-like upward into the aligned plug slot, said plug jacks including catch tongues branching off opposite sides of the plug jack, and each contact chamber having catch channels for receiving the catch tongues, said catch channels being formed on opposite side regions of the contact chamber with the catch channels of adjacent chambers being offset relative to one another in a common partition extending therebetween with the amount of offset being in the direction of the widths of said plug slots and providing no overlap.

2. A plug socket according to claim 1, wherein the catch channels have beveled corner regions with the corner region of neighboring contact chambers facing toward one another.

3. A plug socket according to claim 1, wherein the base member has a locking chamber adjacent the bottom side in communication with said chamber openings, a secondary locking slide having a size less than the size of the locking chamber being inserted in said locking chamber and having a through-plug shaft aligned with each of the contact chambers with each through-plug shaft having a locking edge, said secondary locking slide being displaceable in said locking chamber perpendicular to said plug-in axis between a mounting position and a final position, said mounting position having every plug shaft aligned with the associated contact chamber to enable insertion of a plug jack and in said final position, the locking edge of the through-plug shaft covering a part of a cross-section of the contact chamber to lock an inserted plug jack therein.

4. A plug socket according to claim 3, wherein said plug jacks have a box-shaped section engaged in the contact chambers, and wherein the locking edge of each through-plug shaft engages under said box-shaped section when the secondary locking slide is in the final position.

5. A plug socket according to claim 3, wherein the base member has at least a second set of plug sockets, contact chambers with chamber openings, locking chamber and secondary locking slide, being turned by 180° with respect to the arrangement of said first set.

6. A plug socket according to claim 5, wherein each secondary locking slide arranged in the locking chamber has inter-engaging catch elements provisionally holding the secondary locking slide in said mounting position and for non-releasably securing said secondary locking slide in said final position, said catch elements being provided in an edge region of said secondary locking slide and wall region of the base member.

7. A plug socket according to claim 3, wherein the secondary locking slide has inter-engaging catch elements for provisionally holding the secondary locking slide in said mounting position in the locking chamber and for non-releasably securing said secondary locking slide in said final position, said inter-engaging catch elements being provided in an edge region of the slide engaging grooves in a wall region of the base member.

* * * * *